US009416520B2

(12) United States Patent
Sheehan et al.

(10) Patent No.: US 9,416,520 B2
(45) Date of Patent: Aug. 16, 2016

(54) WEAR PAD ASSEMBLY

(71) Applicant: CATERPILLAR INC., Peoria, IL (US)

(72) Inventors: Paul Anthony Sheehan, Leicester Forest East (GB); Adrian Paul Forrester, Leicester (GB)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/368,518

(22) PCT Filed: Dec. 14, 2012

(86) PCT No.: PCT/US2012/069683
§ 371 (c)(1),
(2) Date: Jun. 25, 2014

(87) PCT Pub. No.: WO2013/101501
PCT Pub. Date: Jul. 4, 2013

(65) Prior Publication Data

US 2014/0345172 A1 Nov. 27, 2014

(30) Foreign Application Priority Data

Dec. 30, 2011 (GB) ..... 1122481.3

(51) Int. Cl.
*E02F 9/28* (2006.01)

(52) U.S. Cl.
CPC ..... *E02F 9/2883* (2013.01)

(58) Field of Classification Search
CPC ..... E02F 3/8152; E02F 9/2883; E02F 9/28; E02F 9/2816; E02F 9/2825; E02F 9/2833
USPC ..... 172/719, 701.3, 772, 772.5
See application file for complete search history.

(56) References Cited

U.S. PATENT DOCUMENTS 564,664 A * 7/1896 Trim et al. ..... E02F 9/2825 37/453
783,764 A * 2/1905 Thomas ..... E02F 9/2825 37/452
868,066 A * 10/1907 Barnhart ..... E02F 9/2825 37/455
981,666 A * 1/1911 Mason ..... E02F 9/2833 37/456
1,107,253 A * 8/1914 Black ..... E02F 9/2816 37/455
1,131,426 A * 3/1915 Rush ..... E02F 9/2825 37/454

(Continued)

FOREIGN PATENT DOCUMENTS

CN 101182719 5/2008
EP 1635002 A 3/2006

(Continued)

OTHER PUBLICATIONS

PCT International Search Report.

(Continued)

*Primary Examiner* — Matthew D Troutman

(57) ABSTRACT

A wear pad assembly for a tool includes a wear-resistant pad having a hole for receiving a fastener. A mounting bracket is attached to the wear-resistant pad and includes a pair of coaxial holes extending through an upper flange and a lower flange of the mounting bracket configured to engage with an upper surface and a lower surface of an edge of the tool. A quick-release pin secures the wear pad assembly to the tool edge by passing through the hole in the wear-resistant pad, the pair of coaxial holes in the upper and lower flanges of the mounting bracket, and a hole in the edge of the tool.

16 Claims, 3 Drawing Sheets

(56) References Cited

U.S. PATENT DOCUMENTS

| | | | | | |
|---|---|---|---|---|---|
| 1,242,715 | A | * | 10/1917 | Nichols | E02F 9/2825 37/455 |
| 1,275,589 | A | * | 8/1918 | Nichols | E02F 9/2825 37/455 |
| 1,340,385 | A | * | 5/1920 | Edmondson | 37/455 |
| 1,543,222 | A | * | 6/1925 | McVeety | 172/701.3 |
| 2,864,184 | A | * | 12/1958 | Fohr | 37/404 |
| 3,736,664 | A | * | 6/1973 | Black | E02F 3/65 37/446 |
| 3,885,833 | A | * | 5/1975 | Lemieux | 299/36.1 |
| 4,120,105 | A | * | 10/1978 | Stepe | 37/455 |
| 4,201,000 | A | * | 5/1980 | Stanford | 37/407 |
| 4,269,275 | A | * | 5/1981 | Cousin | 172/719 |
| 4,420,189 | A | * | 12/1983 | von Ruden | E02F 3/962 172/778 |
| 4,819,349 | A | * | 4/1989 | Mensch | 37/407 |
| 4,932,145 | A | | 6/1990 | Reeves, Jr. | |
| 5,012,599 | A | | 5/1991 | DeClair et al. | |
| 5,471,770 | A | | 12/1995 | Ferreira | |
| 5,596,825 | A | * | 1/1997 | Von Schalscha | 37/407 |
| 5,741,112 | A | | 4/1998 | Lakin et al. | |
| 5,775,013 | A | | 7/1998 | Von Schalscha | |
| 6,041,529 | A | | 3/2000 | Ruvang | |
| 6,986,216 | B2 | | 1/2006 | Emrich et al. | |
| 7,198,687 | B2 | * | 4/2007 | Hill, III | E02F 3/8157 156/130.5 |
| 7,249,429 | B2 | * | 7/2007 | Truan et al. | 37/403 |
| 7,581,340 | B2 | * | 9/2009 | Wolfe | 37/407 |
| 7,617,666 | B1 | * | 11/2009 | Marchese | 56/400.04 |
| 7,726,049 | B2 | * | 6/2010 | Hill, III | E02F 3/8157 15/245 |
| 2005/0241195 | A1 | | 11/2005 | Bierwith | |
| 2006/0042130 | A1 | | 3/2006 | LaHood | |
| 2006/0145489 | A1 | | 7/2006 | Shapiro et al. | |

FOREIGN PATENT DOCUMENTS

| | | | |
|---|---|---|---|
| EP | 1361313 | | 3/2007 |
| GB | 2480567 | A | 11/2011 |
| WO | WO 2011127536 | | 10/2011 |

OTHER PUBLICATIONS

GB Search Report.

* cited by examiner

WEAR PAD ASSEMBLY

CLAIM FOR PRIORITY

This application is a U.S. National Phase entry under 35 U.S.C. § 371 from PCT International Application No. PCT/US2012/069683, filed Dec. 14, 2012, which claims benefit of priority of UK Patent Application No. 1122481.3, filed Dec. 30, 2011, all of which are incorporated herein by reference.

TECHNICAL FIELD

This disclosure is directed to a wear pad assembly for a work tool, and in particular to a wear pad assembly for use with work tools having bucket-like elements, such as front end loaders.

BACKGROUND

Work machines, such as backhoe loaders, are commonly operated on hard finished surfaces such as tarmac work surfaces or roads. In order to stabilise the machine when working, rear stabiliser pads and a front end work tool, such as a loader, are lowered to ground level. However, the forces on the surface resulting from the weight and movement of the machine can result in damage to the surface, which may lead to a penalty or re-work costs for the operator or contractor.

In order to address this problem, it is known to affix wear pads to the rear stabilisers, as described in U.S. Pat. No. 6,386,586. Such wear pads have a lower hardness than the road surface, and thus erode in preference thereto.

Similarly, wear pads may also be affixed to the front end work tool. US-A-2006/0145489 discloses an apparatus for protecting a floor or surface and a bucket or scoop from costly wear and/or damage during material handling operations, wherein the wear pad is configured to be bolted to a bucket or scoop.

However, the front end work tool is typically used for tasks such as lifting, digging, and loading, which tasks may be impeded by the presence of wear pads. Therefore, it would be desirable to have a wear pad which can be quickly attached to a work tool, such as a front end loader, in a non-permanent manner.

SUMMARY

According to one aspect of the present disclosure there is provided a wear pad assembly for a work tool comprising an edge provided with one or more holes, the wear pad assembly comprising:

a wear-resistant pad;

a mounting bracket configured for attachment to the wear-resistant pad; and a quick-release pin for securing the wear pad assembly to the work tool edge.

One exemplary embodiment of a wear pad assembly is as described with reference to, and as shown in the accompanying drawings.

DETAILED DESCRIPTION

Figure 1:
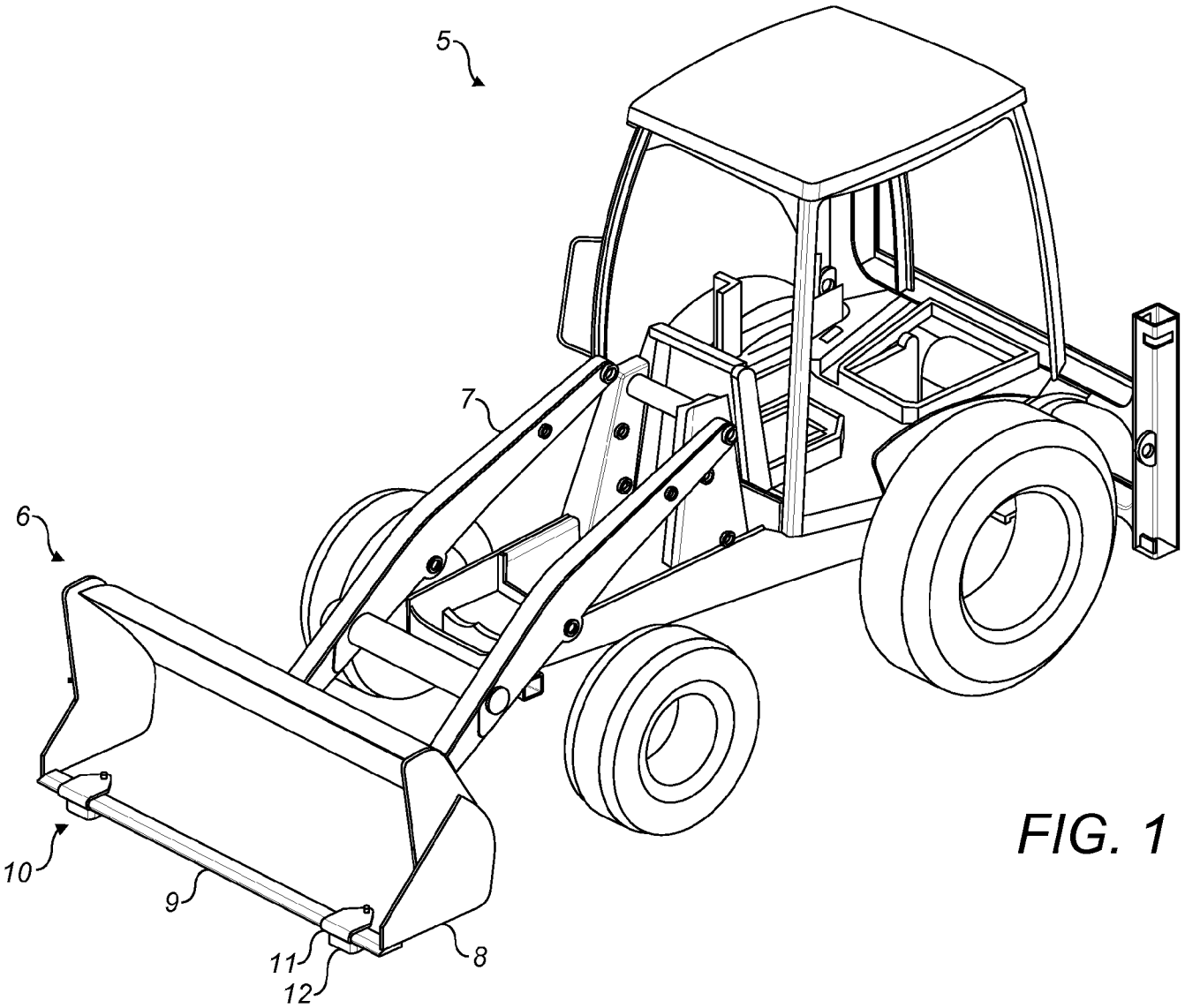
FIG. 1 is a perspective view of a work machine having a wear pad assembly according to the present disclosure secured thereto.

FIG. 1 illustrates a work machine 5 having a front end work tool 6, which in the illustrated embodiment is a front end loader. The work tool 6 may be pivotally connected to the work machine 5 via one of more linkage members 7. The work tool 6 may comprise a bucket-like element 8 having an edge 9, commonly known as a cutting edge, which is provided with one or more mounting holes (not shown). The work tool 6 is typically made of steel or a similar material. At least one wear pad assembly 10 is removably attachable to the edge 9 as shown in FIG. 1.

Figure 2:
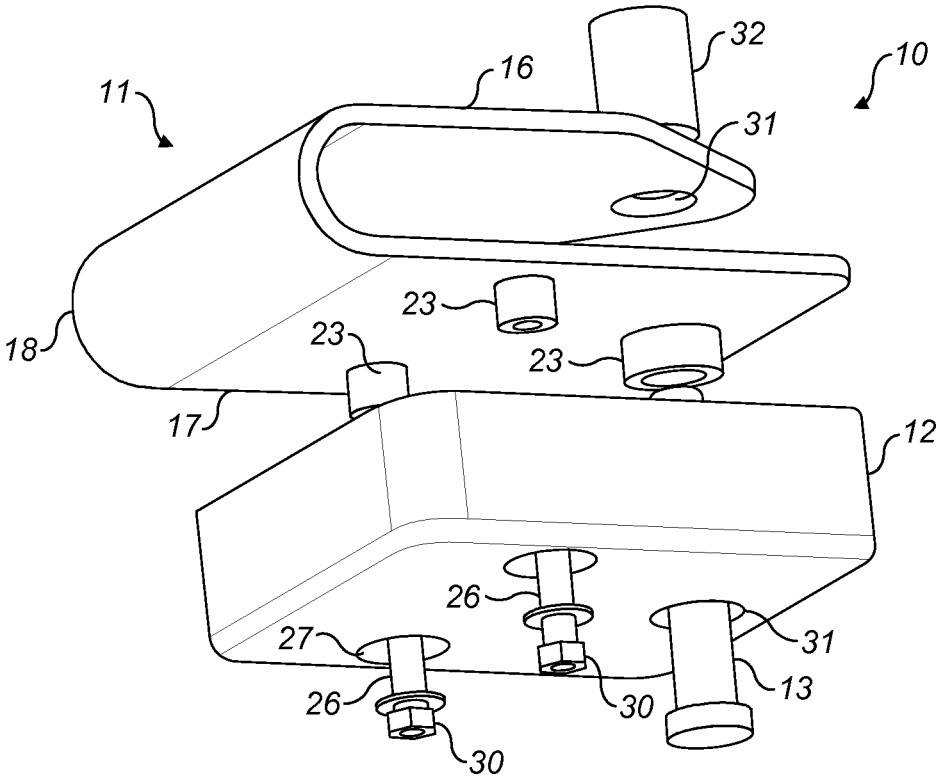
FIG. 2 is an exploded perspective view of the wear pad assembly of FIG. 1.
Figure 3:
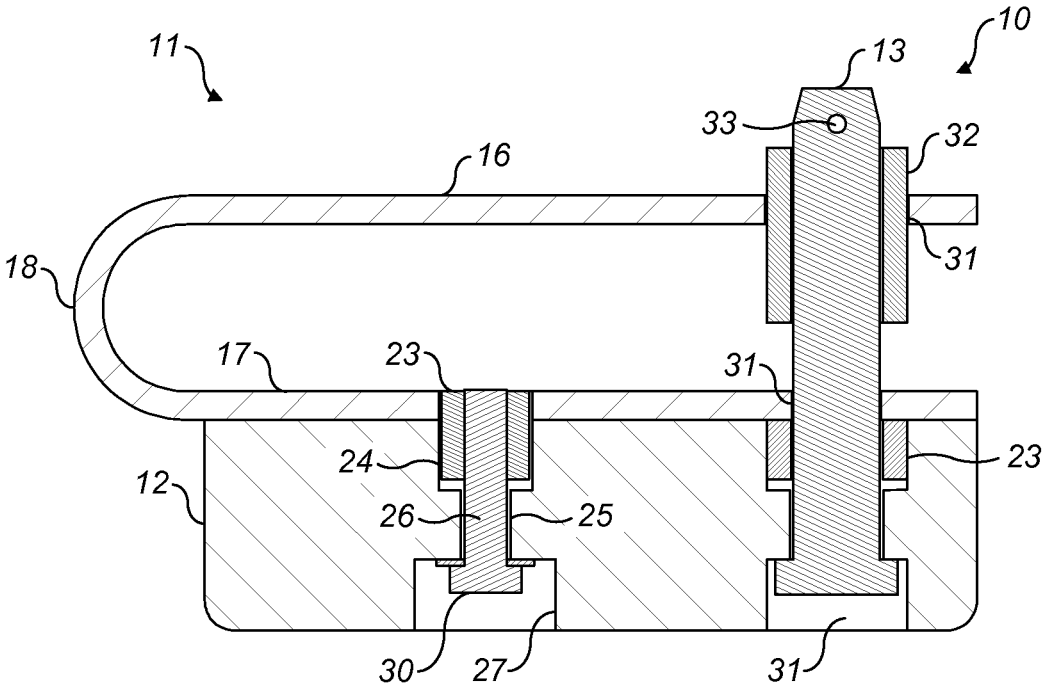
FIG. 3 is a cross-sectional view of the wear pad assembly of FIG. 2.

FIGS. 2 and 3 illustrate the wear pad assembly 10 in greater detail. The wear pad assembly 10 comprises three main components, namely a mounting bracket 11, a wear-resistant pad 12, and a pin 13.

Figure 4:
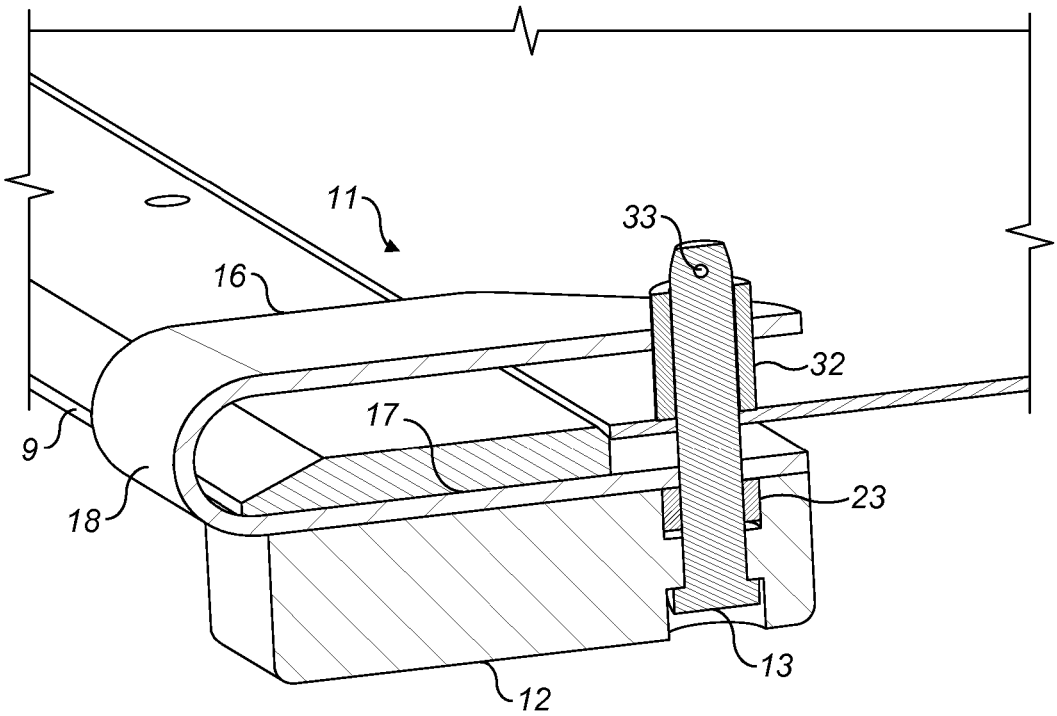
FIG. 4 is a cross-sectional perspective view of the wear pad of FIGS. 2 and 3 located on a work tool of a work machine.

The mounting bracket 11 may be a generally C-shaped component, having a pair of generally parallel flanges 16,17, comprising an upper flange 16 and a lower flange 17, joined by a curved portion 11. The bracket 11 is thus configured for location on the edge 9 of the work tool 6, as shown in FIG. 4. At least one pair of coaxial holes 31 may be provided in the flanges 16,17, for attachment of the mounting bracket 11 to the edge 9 of the work tool 6.

The mounting bracket 11 may be provided with shear lugs 23 for assisting in the location of the wear-resistant pad 12 on the mounting bracket 11. The shear lugs 23 also provide stability to the wear-resistant pad 12, as they resist relative transverse movement between the mounting bracket 11 and the wear-resistant pad 12 when the work machine 5 is being operated.

The mounting bracket 11 may be made from steel or any other suitable material. It may be manufactured by any suitable method, such as fabrication or casting.

The wear-resistant pad 12 may be provided with blind holes 24 for receiving the shear lugs 23 of the mounting bracket 11. The wear-resistant pad 12 may also comprise through holes 25 for receiving fasteners 26, such as bolts. The through holes 25 may be provided with counterbores 27 such that the heads 30 of the fasteners 26 sit flush with or below the outer surface of the wear-resistant pad 12. The blind holes 24 and the through holes 25 may be coincident. This arrangement enables service replacement of the wear-resistant pad 12 as a singular item.

The wear-resistant pad 12 may be made of a wear-resistant compound, such as polyurethane or neoprene, or any suitable rubber material. The wear-resistant pad 12 may be manufactured from a moulding process. The size of the wear-resistant pad 12, in terms of surface area and thickness, is selected according to front end machine weight distribution and surface pressure of the machine 5 on which the wear-resistant pad 12 is to be used.

Figure 5:
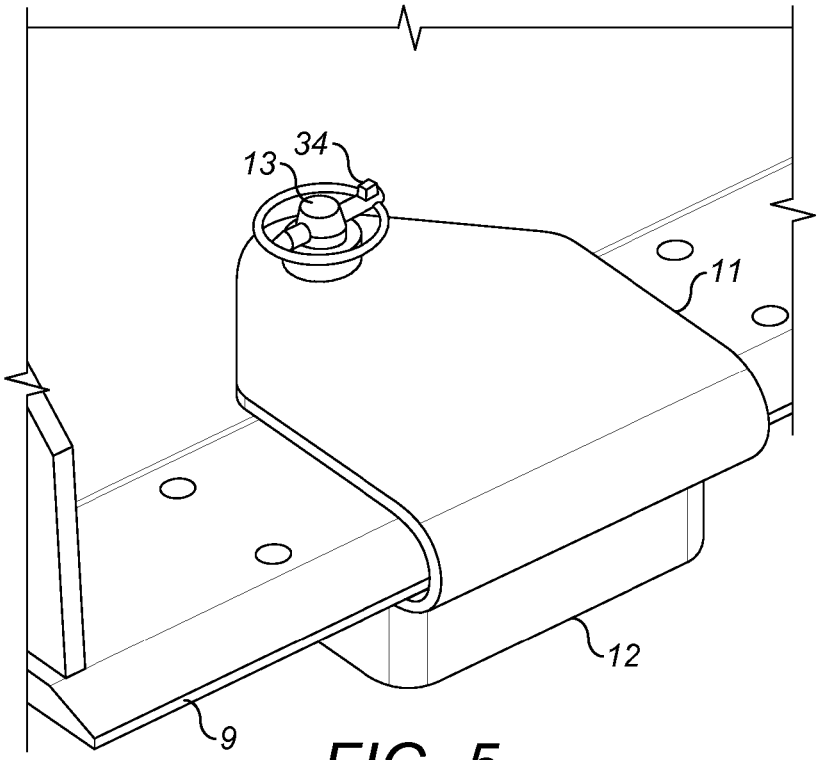
FIG. 5 is a perspective view of the wear pad of FIGS. 2 to 4 located on a work tool of a work machine and secured in place using a linchpin.

The pin 13 is used to attach the mounting bracket 11 and wear-resistant pad 12 to the work tool 6. The pin 13 may be a quick-release type pin, and passes through coaxial holes 31 in the wear-resistant pad 12 and the flanges 16,17 of the mounting bracket 11. A loose collar 32 may be provided to act as a spacer to take up clearance between the pin 13 and the coaxial hole 31 in the upper flange 16 of the mounting bracket 11, and to ensure a close fit therebetween. The pin 13 may comprise a locking mechanism, such as a hole 33 in its upper end for receiving a split pin or a quick-release linchpin 34 (as shown in FIG. 5).

The pin 13 may be made of a steel material, which may be plated in order to enhance its corrosion resistance.

The pin 13 enables the wear pad assembly 10 to be quickly and easily fitted to a variety of work tools 6 having one or more mounting holes. The linchpin 34 or other locking mechanism may be fitted and removed without tools.

INDUSTRIAL APPLICABILITY

The wear pad assembly 10 has industrial applicability in the field of work machines, and may be used on a variety of different work machines, including backhoe loaders, which have a work tool 6 comprising a bucket-like element 8 such as a loader.

The wear pad assembly 10 is attached and secured to the work tool 6 when it is required to lower the work tool 6 to the ground to act as a stabilising leg for the work machine 5. With the work tool 6 raised off the ground, the C-shaped mounting bracket 11 is located on the edge 9 of the work tool 6 over a hole provided thereon. The collar 32 may be positioned in the aligned hole 31 of the mounting bracket 11. The pin 13 is then inserted through the aligned holes 31, and is secured in place using a linchpin 34 or any other suitable locking mechanism.

The wear pad assembly 10 according to the disclosure enables a machine operator to easily and quickly fit a wear pad to a front-end bucket 8.

The invention claimed is:

1. A wear pad assembly for a tool comprising an edge provided with one or more holes, the wear pad assembly comprising:

a wear-resistant pad, wherein the wear-resistant pad includes a through hole for receiving a fastener;

a mounting bracket configured for attachment to the wear-resistant pad and the tool edge, the mounting bracket including a pair of coaxial holes extending through an upper portion and a lower portion of the mounting bracket configured for engagement with an upper surface and a lower surface of the tool edge, respectively;

a quick-release pin configured for securing the wear pad assembly and mounting bracket to the tool edge, the quick-release pin configured for passing through the through hole in the wear-resistant pad, through one of the coaxial holes in the lower portion of the mounting bracket, through one of the one or more holes provided in the tool edge, and through one of the coaxial holes in the upper portion of the mounting bracket, and the quick-release pin including a locking mechanism comprising a hole in an upper end of the quick-release in configured for receiving a pin; and a collar configured to be positioned around one end portion of the quick-release pin to act as a spacer between the quick-release pin and the hole in the upper portion of the mounting bracket.

2. A wear pad assembly according to claim 1, wherein the mounting bracket is configured for releasable attachment to the wear-resistant pad.

3. A wear pad assembly according to claim 1, wherein the mounting bracket comprises a generally C-shaped element.

4. A wear pad assembly according to claim 1, wherein the mounting bracket further comprises an attachment surface for attachment to the wear-resistant pad, the attachment surface comprising one or more shear lugs.

5. A wear pad assembly according to claim 4, wherein the wear-resistant pad comprises one or more blind holes for receiving the one or more shear lugs of the mounting bracket.

6. A wear pad assembly according to claim 1, wherein the wear-resistant pad comprises one or more through holes for receiving fasteners for attachment of the wear-resistant pad to the mounting bracket.

7. A wear pad assembly according to claim 6, wherein the one or more through holes are counterbored.

8. A wear pad assembly according to claim 6, wherein one or more blind holes for receiving the fasteners and the one or more through holes are coaxial.

9. A wear pad assembly according to claim 1, wherein the locking mechanism is a linchpin.

10. A machine having a tool comprising an edge provided with one or more holes, and further comprising at least one wear pad assembly secured to the edge via the one or more holes, the wear pad assembly comprising:

a wear-resistant pad, wherein the wear-resistant pad includes a through hole for receiving a fastener;

a mounting bracket configured for attachment to the wear-resistant pad and the tool edge, the mounting bracket including an upper portion configured to engage an upper surface of the tool edge and a lower portion configured to engage a lower surface of the tool edge, and a pair of coaxial holes extending through the upper portion and the lower portion of the mounting bracket;

a quick-release pin configured for securing the wear-resistant pad and mounting bracket to the tool edge, the quick-release pin passing through the through hole in the wear-resistant pad, through a hole in the lower portion of the mounting bracket, through one of the one or more holes provided in the edge of the tool, and through a hole in the upper portion of the mounting bracket, and the quick-release pin including a locking mechanism comprising a hole in an upper end of the quick-release pin configured for receiving a pin, and a collar positioned around one end portion of the quick-release pin as a spacer between the quick-release pin and the hole in the upper portion of the mounting bracket.

11. A machine according to claim 10, wherein the tool is a bucket.

12. A machine according to claim 11, wherein the bucket is a loader bucket.

13. A machine comprising:

a tool comprising an edge provided with one or more holes; and a wear pad assembly secured to the edge of the tool via the one or more holes, said wear pad assembly comprising:

a wear-resistant pad, wherein the wear-resistant pad includes one or more through holes for receiving fasteners;

a mounting bracket configured for attachment to the wear-resistant pad and the tool edge, the mounting bracket including an upper flange configured to engage an upper surface of the tool edge and a lower flange configured to engage a lower surface of the tool edge, and one or more pairs of coaxial holes extending through the upper flange and the lower flange of the mounting bracket;

a quick-release pin configured for securing the wear-resistant pad and mounting bracket to the tool edge, the quick-release pin passing through one of the one or more through holes in the wear-resistant pad, through a hole in the lower flange of the mounting bracket, through one of the one or more holes provided in the tool edge, and through a hole in the upper flange of the mounting bracket, and the quick-release in including a locking mechanism comprising a hole in an upper end of the quick-release in configured for receiving a pin, and a collar positioned around one end portion of the quick-release pin as a spacer between the quick-release pin and the hole in the upper flange of the mounting bracket.

14. The machine of claim 13, wherein the mounting bracket further comprises an attachment surface for attachment to the wear-resistant pad, the attachment surface comprising one or more shear lugs.

15. The machine of claim 14, wherein the wear-resistant pad comprises one or more blind holes for receiving the one or more shear lugs of the mounting bracket.

16. The machine of claim 13, wherein the mounting bracket comprises a generally C-shaped element.

* * * * *